US006250849B1

(12) United States Patent
Marianski et al.

(10) Patent No.: US 6,250,849 B1
(45) Date of Patent: Jun. 26, 2001

(54) INTERCONNECTED CRIBBING SYSTEM

(75) Inventors: James E. Marianski; Andrew J. Marianski, both of Bristol, TN (US)

(73) Assignee: American Commercial Inc., Bristol, VA (US)

( * ) Notice: Subject to any disclaimer, the term of this patent is extended or adjusted under 35 U.S.C. 154(b) by 0 days.

(21) Appl. No.: 09/347,073

(22) Filed: Jul. 2, 1999

(51) Int. Cl.[7] ..... E05D 17/00

(52) U.S. Cl. ..... 405/273; 405/284; 405/288

(58) Field of Search ..... 52/233; 446/106, 446/85; 405/273, 272, 303, 283, 288, 284, 285, 286

(56) References Cited

U.S. PATENT DOCUMENTS

| | | | | |
|---|---|---|---|---|
| 400,693 | | 4/1889 | Lawrence . | |
| 710,115 | | 9/1902 | Neuman . | |
| 1,312,331 | | 8/1919 | Kirchner . | |
| 1,398,695 | * | 11/1921 | Hull | 405/273 |
| 1,402,438 | | 1/1922 | Nichols . | |
| 1,424,481 | * | 8/1922 | Isoardi | 405/273 |
| 1,704,941 | | 3/1929 | Hobson et al. . | |
| 1,707,224 | | 4/1929 | Hobson et al. . | |
| 1,749,303 | | 3/1930 | Rutter . | |
| 2,190,556 | | 2/1940 | Wiebecke et al. | 262/1 |
| 2,315,441 | * | 3/1943 | McDaniel | 405/288 |
| 2,820,349 | * | 1/1958 | Cooper | 405/283 |
| 2,832,100 | | 4/1958 | Swallert | 20/4 |
| 2,972,870 | * | 2/1961 | Cooper | 405/273 |
| 4,628,658 | | 12/1986 | Erasmus | 52/561 |
| 4,664,562 | | 5/1987 | Clark et al. | 405/273 |
| 4,840,003 | | 6/1989 | Lucas et al. | 52/233 |
| 4,997,315 | | 3/1991 | Clark | 405/273 |
| 5,015,125 | | 5/1991 | Seegmiller | 405/288 |
| 5,143,484 | | 9/1992 | Deul | 405/288 |
| 5,435,670 | | 7/1995 | Pienaar et al. | 405/289 |
| 5,746,547 | | 5/1998 | Reinmann et al. | 405/288 |
| 6,079,910 | * | 6/2000 | Marianski et al. | 405/288 |

FOREIGN PATENT DOCUMENTS

| | | |
|---|---|---|
| 2270934 | 3/1994 | (GB) . |
| 5545953 | 3/1980 | (JP) . |
| 7900567 | 8/1979 | (WO) . |
| 852519 | 4/1985 | (ZA) . |
| 862467 | 4/1986 | (ZA) . |
| 911265 | 2/1991 | (ZA) . |
| 923628 | 5/1992 | (ZA) . |
| 934786 | 7/1993 | (ZA) . |

* cited by examiner

*Primary Examiner*—Robert E. Pezzuto
(74) *Attorney, Agent, or Firm*—Webb Ziesenheim Logsdon Orkin & Hanson, P.C.

(57) ABSTRACT

A cribbing system for supporting a mine roof or the like includes a multi-sided column. Each column is formed of a stack of cribbing elements with each cribbing element having upper and lower surfaces wherein substantially the entire upper and lower surface of each cribbing element is a bearing surface for transmitting a substantially vertical load to a vertically adjacent cribbing element of one stack. Each cribbing element is interconnected with at least one cribbing element of an adjacent side. The interconnection between interconnected cribbing elements is formed by a slot extending through one of the interconnected cribbing elements in the direction of the column and a matching projection on at least the other interconnected cribbing elements, with each projection extending in the direction of the column for the height of the cribbing element. The cribbing system may be a wooden cribbing system having two distinctly different sets of cribbing elements.

19 Claims, 2 Drawing Sheets

INTERCONNECTED CRIBBING SYSTEM

BACKGROUND OF THE INVENTION

1. Field of the Invention

The present invention relates to a cribbing system such as for supporting a mine roof. More particularly, the present invention relates to a wooden interconnected cribbing system which maximizes bearing surface contact area between adjacent cribbing members.

2. Background Information

Wooden cribbing systems have long been used for supporting mine roofs and the like. Typically, a cribbing system is a column type structure formed by several layers of overlapped cribbing elements. Individual cribbing elements have been called cribs, blocks and logs. The interconnection of overlapping cribbing elements has been accomplished by notching of one or both of adjacent cribbing elements. Examples of this interconnection can be found in U.S. Pat. Nos. 400,693; 710,115; 1,312,331; 1,704,941; 1,707,224; 1,749,303; 4,664,562; 4,840,003; 4,997,315 and 5,746,547. The interconnection of adjacent cribbing elements prevents slippage between adjacent cribbing elements which will maintain proper contact between the bearing surfaces thereof. The bearing surface generally refers to the area of the cribbing element which transfers the load to an adjacent cribbing element. In many cribbing systems, only the corner crossing points are load bearing or bearing surfaces. Cribbing systems have been designed to increase or maximize the bearing surface between adjacent cribbing elements. For example, the cribbing system disclosed in U.S. Pat. No. 5,746,547 has substantially the entire surface of the cribbing elements acting as a bearing surface.

The existing cribbing systems include disadvantages. The overlapping arrangement of many designs results in overhanging portions which can prematurely fracture or incur undue stresses. The notching orientation may limit the load carrying capabilities of the cribbing system even where the entire surface of the cribbing element acts as a bearing surface.

It is an object of the present invention to overcome the aforementioned difficulties with the prior art. It is a further object of the cribbing system of the present invention to provide a cribbing system which maximizes the bearing surfaces of the cribbing elements. Another object of the cribbing system of the present invention is to provide a cribbing system with minimal components that is easy to assemble and manufacture.

SUMMARY OF THE INVENTION

The above objects are achieved with a cribbing system according to the present invention. The cribbing system according to the present invention includes a multi-sided column with each side formed of a stack of cribbing elements. Each cribbing element has spaced upper and lower surfaces wherein substantially the entire upper and lower surface of each cribbing element is a bearing surface for transmitting a substantially vertical load to a vertically adjacent cribbing element of one stack. Each cribbing element is interconnected with at least one cribbing element of an adjacent side. The connection between interconnected cribbing elements is formed by a slot extending through one of the interconnected cribbing elements in the direction of the column and a matching projection on at least the other interconnected cribbing elements, with each projection extending in the direction of the column for the height of the cribbing element.

In one embodiment of the present invention, at least two sets of cribbing elements are provided. Each cribbing element of a first set includes a plurality of interconnecting slots and each cribbing element of a second set includes a plurality of matching projections which interconnect with the slots of the first set of cribbing elements. The cribbing elements of the second set may include a pair of matched projections with one projection at each longitudinal end of the cribbing elements. Each slot of the first set can be formed as a T-shaped slot extending the entire height of the cribbing element. The width of the T-shaped slot may be substantially equal to the width of a cribbing element.

The column cribbing system of the present invention provides that the cribbing elements of the stack of one side of the column are offset from the cribbing elements of two adjacent sides of the column. An offset between the sides provides that each cribbing element is interconnected with at least two cribbing elements of each adjacent side of the column. The cribbing elements according to the present invention are specifically designed to be formed from rectangular wooden members.

These and other advantages of the present invention will be clarified in the description of the preferred embodiments taken together with the attached figures wherein like reference numerals represent like elements throughout.

DETAILED DESCRIPTION OF THE PREFERRED EMBODIMENTS

Figure 1:
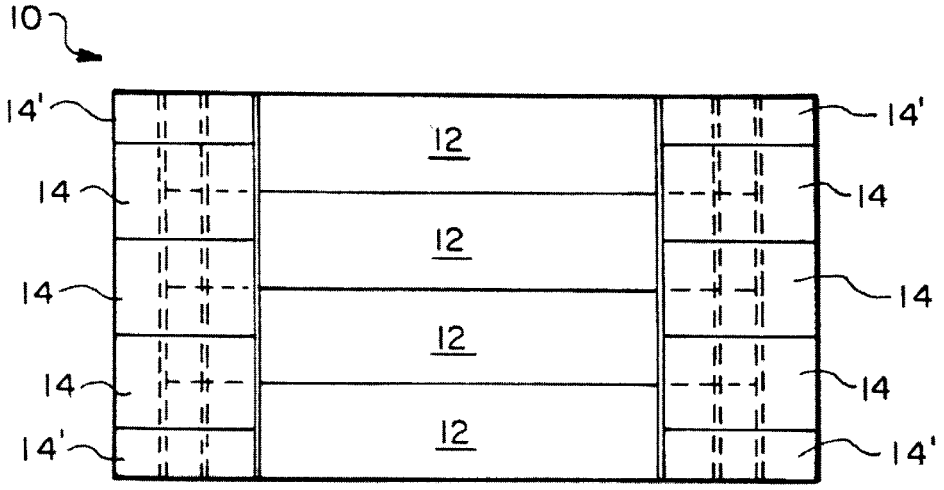
FIG. 1 is a side elevational view of a column cribbing system according to one embodiment of the present invention.
Figure 2:
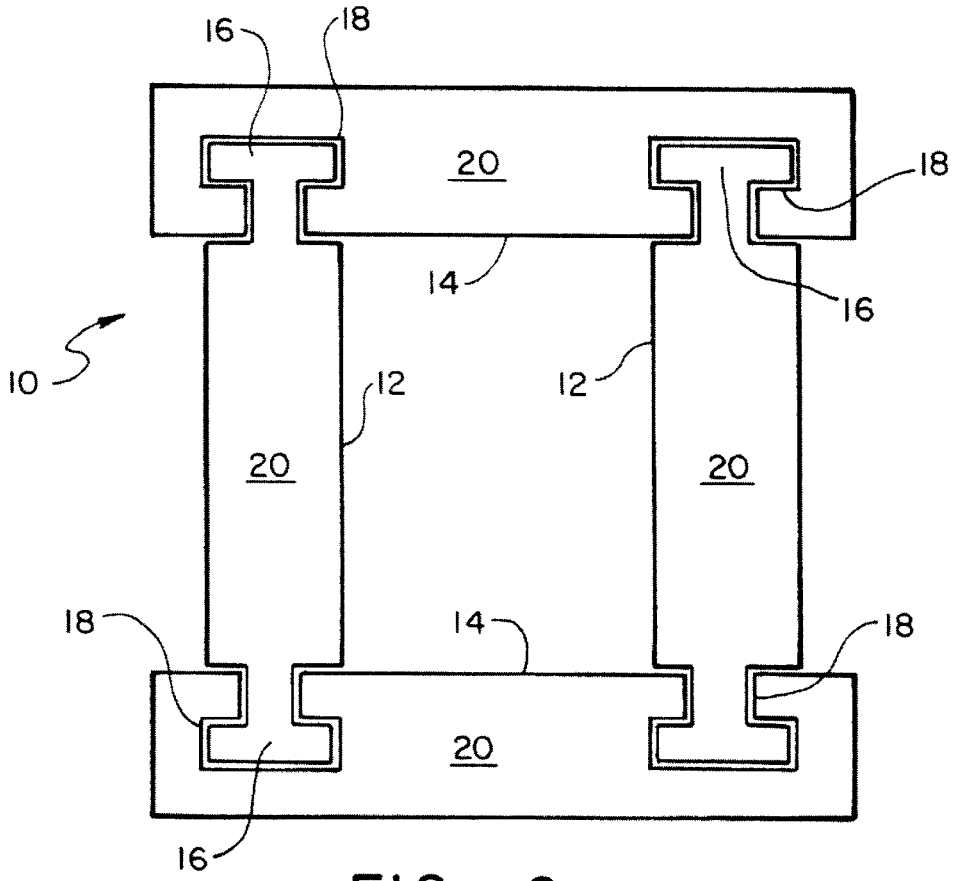
FIG. 2 is a plan view of the column cribbing system illustrated in FIG. 1.

FIGS. 1 and 2 illustrate a column cribbing system 10 according to a first embodiment of the present invention. The column cribbing system 10 illustrated in FIGS. 1 and 2 is a four-sided column, with each side formed of a stack of cribbing elements 12 or 14.

Each cribbing element 12 includes a T-shaped projection 16 at each end of the cribbing element 12. The T-shaped projection 16 extends the entire height of the cribbing element 12. Each T-shaped projection 16 engages with a T-shaped slot 18 formed on the side of cribbing element 14. Each T-shaped slot 18 extends through the cribbing element 14 in the direction of the column for the entire height of the cribbing element 14.

Each cribbing element 12 and 14 includes planar upper and lower bearing surfaces 20 extending across the entire surface of the respective cribbing elements 12 and 14, as shown in FIG. 2. The bearing surface 20 covers the entire upper and lower surface of the respective cribbing elements 12 and 14 to transfer a vertical load from that cribbing element 12 or 14 to a vertically adjacent cribbing element.

As shown in FIG. 2, the T-shaped projections 16 of the cribbing elements 12 engage with the T-shaped slots 18 of the cribbing elements 14 to interconnect each cribbing element 12 with adjacent elements 14 on both adjacent sides.

Additionally, as shown in FIG. 1, the rows of cribbing elements 12 and cribbing elements 14 are offset from each other such that each cribbing element 12 engages two cribbing elements 14 on each side of the column. The stacks of cribbing elements 12 and 14 are most easily offset from each other by utilizing a partial cribbing element 14'. The partial cribbing element 14' is only a fraction of the height of an ordinary cribbing element 12 or 14. In FIG. 1, the lower and upper ends of the stack of cribbing elements 14 include a partial cribbing element 14' which is formed by a cribbing element 14 that is cut in half such that the partial cribbing elements 14' have a height which is one-half the height of a cribbing element 14.

The individual cribbing elements 12 and 14 are preferably made of wood, but can be formed of other materials. The specific interconnection of the cribbing elements 12 and 14 is designed for easy construction out of wood as well as to provide the greatest amount of bearing surface 20 for each of the cribbing elements 12 and 14 without minimizing the vertical loading capabilities of any portion of the cribbing elements 12 and 14. More complex interconnecting arrangements can be utilized where the cribbing elements 12 and 14 are formed out of concrete. However, as discussed above, the present invention is designed to provide a column cribbing system 10 which is easily fabricated out of wood.

The dimensions of the individual cribbing elements 12 and 14 can be made essentially in any size desired. It is expected that the length of the cribbing elements 12 or 14 will come in a variety of conventional sizes for use in a mine environment or the like. One proposed set of sizes would be for example, 18, 24, 30, 36, 42 and 48 inches. The width and height of each cribbing element 12 and 14 may also be made in any conventional size such as, for example, 6×6 inch timbers. One dimension which is helpful in minimizing the construction of the column cribbing system 10 is having the width of the upper portion of the T-shaped slot 18 be equal to the width of the cribbing element 12. This results in the width of the upper portion of the T-shaped projection 16 being equal to the width of the cribbing element 12 such that the T-shaped projection 16 is easily formed by simply machining, cutting or otherwise forming two undercuts therein.

The column cribbing system 10 is not limited to a four-sided column, but can be manufactured as three, five or six-sided, or the like, with appropriate modification in the angle of the T-shaped slots 18 as well as the corresponding T-shaped projections 16. Additionally, the column cribbing system 10 is not limited to utilizing partial cribbing elements 14' which are exactly one-half the height of the remaining cribbing elements 12 and 14. Other offsets or fractional heights may also be utilized.

The assembly operation of the column cribbing system 10 according to the present invention, is believed to be obvious and well-known to those of skill in the art. The column cribbing system 10 is built by laying the first layer of cribbing elements 12 and partial cribbing elements 14' to begin construction of the column. Subsequent interlocking cribbing elements 12 and 14 are laid vertically on top of each other to form the column of the desired height. After the final cribbing elements 12 and 14 have been positioned, as well as the final partial cribbing elements 14', shimming or cap members (not shown) may be slid into place to fill the gap, if any, between the top of the column and the mine roof. Additionally, it is understood that the column may be built on top of a base (not shown).

The column cribbing system 10 of the present invention provides an interlocked column which is easy to manufacture and assemble and maximizes the bearing surface between the cribbing elements. Furthermore, by having the slots 18, as well as the undercuts forming the T-shaped projections 16, extend through the entire height of each cribbing element 12 and 14, the column cribbing system 10 avoids cribbing elements which are weakened with respect to vertical loading.

Figure 3:
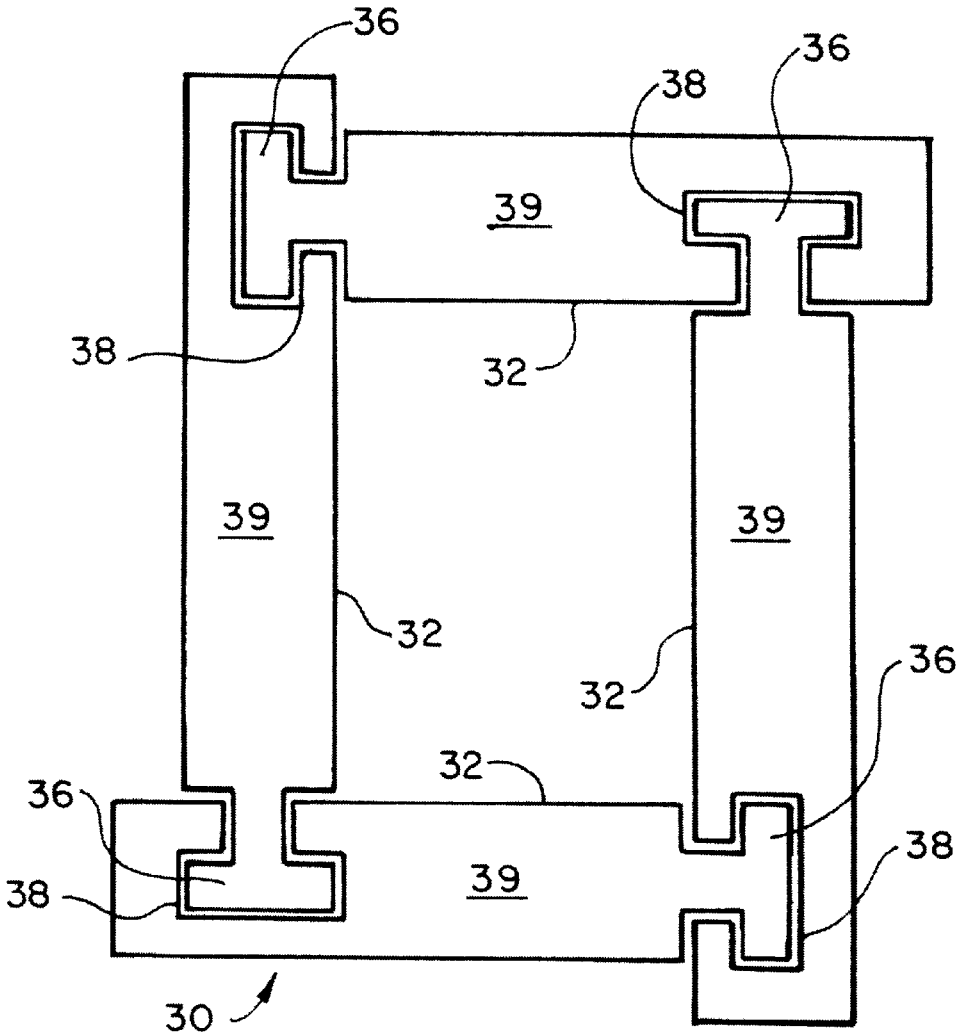
FIG. 3 is a plan view of a column cribbing system according to a second embodiment of the present invention.

FIG. 3 illustrates a modified column cribbing system 30. The column cribbing system 30 is formed of a universal cribbing element 32. The cribbing element 32 includes a T-shaped projection 36 on one longitudinal end of the cribbing element 32 and a T-shaped slot 38 on a side thereof. The entire upper and lower surface of each cribbing element 32 forms a bearing surface 39 for transferring a substantially vertical load to a vertically adjacent cribbing element 32 in each side of the column cribbing system 30. The column cribbing system 30 allows a single cribbing element 32 to be manufactured and used for forming the column. Other than this distinction, the column cribbing system 30 operates in the same manner and has the same advantages of the column cribbing system 10 described above.

Figure 4:
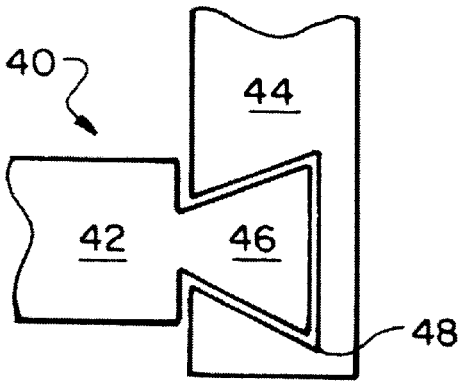
FIG. 4 is a plan view of a portion of a column cribbing system according to a third embodiment of the present invention.

FIG. 4 illustrates a portion of a modified cribbing system 40. The modified cribbing system 40 includes cribbing elements 42 and 44. The cribbing element 42 includes a dovetail projection 46 received within a dovetail slot 48 on the side of the cribbing element 44. The cribbing elements 42 and 44 may be identical in shape similar to the universal cribbing element 32 or may be formed with either two projections 46 or two slots 48 similar to cribbing elements 12 and 14. The modified cribbing system 40 operates in the same manner as cribbing systems 10 and 30 described above. The modified cribbing system 40 simply utilizes a different shape for the interconnecting projection and slot. The width of the end of the dovetail projection 46 may be equal to the width of the cribbing element 42. However, unlike the projections 16 and 36, having the width of the end of the projection 46 be less than the width of the cribbing element would not lead to additional machining time.

It will obvious to those of ordinary skill in the art that various modifications may be made to the present invention without departing from the spirit and scope thereof. Consequently, the scope of the present invention is intended to be defined by the appended claims and equivalents thereto.

We claim:

1. A cribbing system comprising a multi-sided column, each side formed of a stack of cribbing elements, each cribbing element having spaced upper and lower surfaces wherein substantially the entire upper and lower surface of each cribbing element is a bearing surface for transmitting a substantially vertical load to a vertically adjacent cribbing element of one stack, and wherein each cribbing element is interconnected with at least one cribbing element of an adjacent side, a connection between interconnected cribbing elements is formed by a slot extending through one of the interconnected cribbing elements in the direction of the column and a matching projection on at least the other interconnected cribbing element, each projection extending in the direction of the column for the height of the cribbing element.

2. The cribbing system of claim 1 wherein the cribbing elements include at least two sets of distinct cribbing elements, each cribbing element of a first set of cribbing elements including a plurality of the interconnecting slots and each cribbing element of a second set of cribbing elements including a plurality of the matching projections which interconnect with the slots of the first set of cribbing elements.

3. The cribbing system of claim 2 wherein each cribbing element of the second set of cribbing elements includes a pair of the matching projections, one projection at each longitudinal end of the cribbing element.

4. The cribbing system of claim 2 wherein each interconnecting slot is a T-shaped slot in profile.

5. The cribbing system of claim 4 wherein each matching projection is a T-shaped projection wherein the width of the top of the T is substantially equal to the width of the cribbing element.

6. The cribbing system of claim 2 wherein each matching projection is a dovetail shaped projection.

7. The cribbing system of claim 1 wherein each cribbing element is a substantially rectangular wooden member.

8. The cribbing system of claim 1 wherein the cribbing elements of a stack of one side of the column are offset from the cribbing elements of two adjacent sides of the column.

9. The cribbing system of claim 8 wherein the offset between the sides provides that each cribbing element is interconnected with at least two cribbing elements of each adjacent side of the column.

10. The cribbing system of claim 1 wherein each interconnecting slot is a T-shaped slot in profile.

11. The cribbing system of claim 10 wherein each matching projection is a T-shaped projection wherein the width of the top of the T is substantially equal to the width of the cribbing element.

12. The cribbing system of claim 1 wherein each matching projection is a dovetail shaped projection.

13. A column cribbing system comprising:

a first set of stacked cribbing elements forming one side of the column cribbing system, each cribbing element of the first set including spaced top and bottom surfaces wherein substantially the entire top and bottom surface of each cribbing element is a first set cribbing element bearing surface for transferring a substantially vertical load to an adjacent cribbing element of the first set, each cribbing element of the first set including a plurality of slots extending therethrough in a direction of the column; and a second set of stacked cribbing elements forming another side of the column cribbing system, each cribbing element of the second set including spaced top and bottom surfaces wherein substantially the entire top and bottom surface of each cribbing element is a second set cribbing element bearing surface for transferring a substantially vertical load to an adjacent cribbing element of the second set, each cribbing element of the second set including a plurality of locking projections, each locking projection extending in the direction of the column for the height of the cribbing element, wherein the first set of cribbing elements is interlocked with the second set of cribbing elements by one of the locking projections of each cribbing element of the second set engaging one slot of at least one cribbing element of the first set.

14. The cribbing system of claim 9 wherein each cribbing element is wooden.

15. The cribbing system of claim 14 wherein the width of an end of each said projection is equal to the width of said cribbing element.

16. The cribbing system of claim 14 wherein each interconnecting slot is a T-shaped slot in profile.

17. The cribbing system of claim 14 wherein each matching projection is a T-shaped projection wherein the width of the top of the T is substantially equal to the width of the cribbing element.

18. The cribbing system of claim 14 wherein each matching projection is a dovetail shaped projection.

19. The cribbing system of claim 13 wherein the cribbing elements of a stack of one side of the column are offset from the cribbing elements of two adjacent sides of the column.

* * * * *